United States Patent [19]

Kwaan

[11] Patent Number: 4,532,969

[45] Date of Patent: Aug. 6, 1985

[54] FLUID WITHDRAWAL AND INSTILLATION DEVICE

[76] Inventor: Hau C. Kwaan, 347 Jeffrey La., Northfield, Ill. 60093

[21] Appl. No.: 534,342

[22] Filed: Sep. 21, 1983

[51] Int. Cl.[3] ..... B65B 3/02

[52] U.S. Cl. ..... 141/27; 141/29; 141/285; 141/98

[58] Field of Search ..... 141/2, 4–7, 141/18, 21–29, 98, 54–58, 59, 285, 301–310, 319, 329; 604/407, 414

[56] References Cited

U.S. PATENT DOCUMENTS

| | | | |
|---|---|---|---|
| 3,650,305 | 3/1972 | Hendershot | 141/55 X |
| 3,941,171 | 3/1976 | Ogle | 141/309 |
| 4,253,501 | 3/1981 | Ogle | 141/27 |

FOREIGN PATENT DOCUMENTS

| | | | |
|---|---|---|---|
| 704962 | 4/1941 | Fed. Rep. of Germany | 141/285 |
| 1071487 | 9/1954 | France | 604/414 |

*Primary Examiner*—Henry K. Artis
*Assistant Examiner*—Ernest G. Cusick
*Attorney, Agent, or Firm*—Ronald H. Kullick

[57] ABSTRACT

A fluid transfer device utilizing a rotatable value assembly attached to two hollow core needles, which employs atmospheric air pressure to assist with the withdrawal of fluid from a first rubber stoppered container and during instillation of fluid into a second rubber stoppered container, permits air displaced from the second container to be evacuated therefrom. The device enables fluid to be withdrawn from a stoppered bottle with ease by eliminating the build up of a negative pressure in the bottle. Conversely, during instillation of fluid into a stoppered bottle, the device eliminates the build up of a positive pressure therein by the venting of displaced air.

5 Claims, 11 Drawing Figures

FLUID WITHDRAWAL AND INSTILLATION DEVICE

BACKGROUND OF INVENTION

To preserve activity and/or stability, many medicaments particularly those for injection or infusion, are prepared in a powdered or lyophilized form and packaged in sterile containers, generally tightly sealed with a rubber stopper to permit reconstitution with the desired diluent, usually sterile water for injection or normal saline solution. Often, such medicaments are toxic, irritating or mutagenic, particularly when reconstituted, should they come in contact with exposed body tissue. Also, such medicaments are often expensive and present in measured dosage amounts. Thus, to a person whose function it is to reconstitute such medicaments, means for effecting reconstitution without spillage is highly desirable and often imperative.

Presently, reconstitution is generally accomplished utilizing a conventional single bore needle mounted on a conventional syringe. To withdraw the dilution fluid, the needle is inserted through a rubber stopper cap of a sterile container containing the fluid. Fluid is forcibly removed from the container by suction created by withdrawal of the syringe plunger. As liquid is withdrawn, a significant negative pressure is created within the bottle. The creation of this negative pressure thus requires that considerable pulling force be exerted on the syringe plunger to remove the diluent from the container. The application of such force increases the opportunity for the preparer to spill, contaminate, mismeasures or otherwise mishandle the diluent and/or syringe thereby wasting costly materials and time. Also, spillage on to skin of preparer will be potentially hazardous to his or her health. Further, the preparer is often required to make several such withdrawals during a given period, resulting in strained, and at times, injured muscles and/or nerves, particularly in the wrist and forearm area.

Likewise, dilution of a medicament utilizing a conventional needle/syringe method is cumbersome and difficult and can result in wasted or inaccurately reconstituted medicament. During the instillation procedure, the needle attached to the syringe containing the diluent removed from the first container, is inserted into and through the rubber stopper cap of the sterile container containing the medicament. The diluent is then injected into the medicament container by a pushing action on the plunger of the syringe. The introduction of the diluent into the container creates a significant positive pressure therein, making the introduction of the diluent progressively difficult as the pressure within the medicament container builds up. For example, the introduction of 25 ml of liquid into a 27.5 ml capacity bottle will compress air within the bottle such that the pressure within the bottle would be approximately ten atmospheres. In the usual practice, to prevent such a high pressure gradient from building up, repeated exchanges of smaller volumes of diluent for air between the medicament container and syringe are made. This process is likewise cumbersome and time consuming. Moreover, this repeated diluent/air exchange procedure under a large pressure gradient, often results in a leak in the rubber stopper cap of the medicament container, which can result in spillage of medicament, which as indicated above, is often toxic, highly irritating and potentially mutagenic to the person preparing the material. This can result in serious injury and in addition, result in wasted and/or inaccurately diluted medicament.

SUMMARY OF THE INVENTION

It is a primary object of the present invention to provide a fluid transfer device overcoming the disadvantages inherent in existing devices discussed above. The device of the present invention provides means for utilizing atmospheric pressure to facilitate the withdrawal of fluid from a sterile container into a syringe for transfer to a second sterile container containing a medicament, utilizing an air release means to reduce the pressure gradient in the second container, during the transfer of fluid in said syringe to said second container, thereby reducing the possibility of spillage, contamination and/or inaccurate measurement.

The above objects are accomplished by the invention described below:

DESCRIPTION OF THE PREFERRED EMBODIMENT

Figure 1:
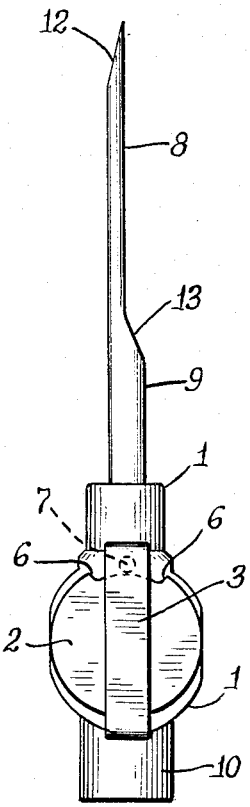
FIG. 1 is a front view of one embodiment of the invention.
Figure 2:
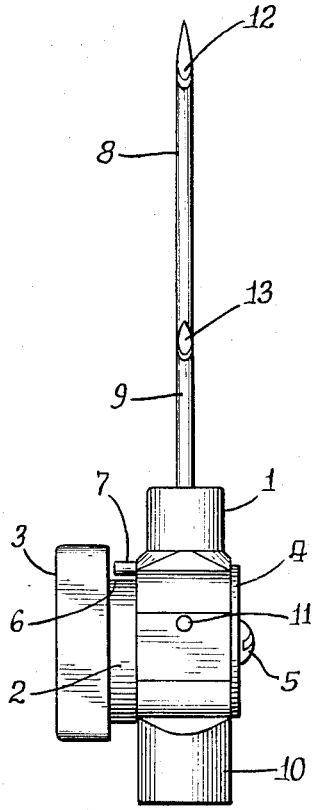
FIG. 2 is a side view of the same embodiment of FIG. 1.
Figure 3:
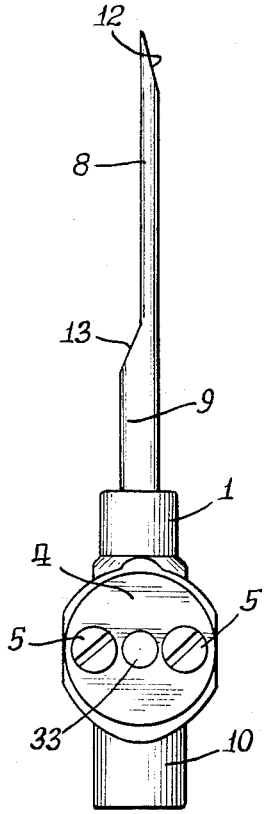
FIG. 3 is a rear view of the same embodiment of FIG. 1.

An embodiment of the invention is set forth in FIGS. 1–3. The device of this invention includes an outer frame member 1; an inner movable rotary core member 2, with handle 3, fixably attached thereto for manually rotating said rotary core member 2; cap 4 attached by securing means 5 to and maintaining said inner rotary core member 2 in sealed communication within said outer frame member 1; limiting points 6 on said rotary core member 2 which come in contact with restraining member 7 and which limits movement of said rotary core member 2 to the desired switched position; first long single hollow core needle 8 with opening 12 and second short single hollow core needle 9 containing opening 13 in parallel alignment with long needle 8, needles 8 and 9 being attached to upper portion of outer frame member 1; and hollow attachment means 10, fixably attached to the lower portion of said outer frame member 1, which attachment means communicates with a collecting means preferably a hypodermic syringe.

FIG. 2 discloses air passage 11. Not pictured in FIG. 2 but pictured in cross section views 5A and 5B, is air passage 11A. The function of these passages will be explained below.

Outer frame member 1, rotary core member 2, cap 4, securing means 5 and hollow attachment means 10 can be of any suitable material such as polypropylene, metal such as stainless steel or combination thereof. Hollow core needles 8 and 9 are generally stainless steel. The device may be disposable or be constructed of material and in such a manner which will withstand autoclave temperatures to enable repeated usage.

Figure 4A:
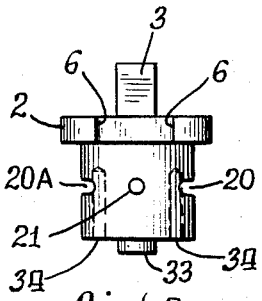
FIGS. 4A, 4B, 4C and 4D are top, side, bottom and rear views respectively of the rotary core member portion of the device of the invention.

FIG. 4A discloses a top view of inner rotary core member 2 comprising handle 3, rotary core air passageways 20 & 20A, rotary core fluid passageway 21, cap alignment means 33 and cap securing means recepticles 34.

Figure 4B:
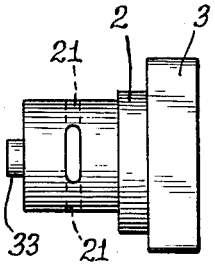

FIG. 4B discloses a side view of said inner rotary core member 2, with the same elements as described in respect to FIG. 4A.

Figure 4C:
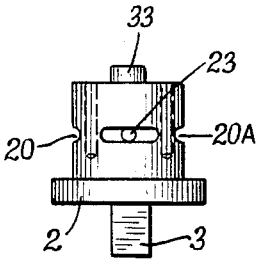

FIG. 4C discloses a bottom view of said inner rotary core member 2 disclosing the elements described in respect to FIG. 4A and in addition, the lower end 23 of fluid passageway 21.

Figure 4D:
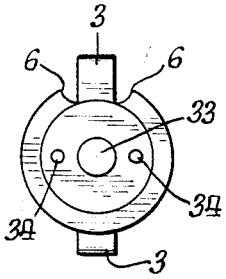

FIG. 4D discloses a rear view of said inner rotary core member 2 with the same elements described in respect to FIG. 4A and in addition, limiting points 6.

Inner rotary core member 2 is of a size and shape such as to fit in rotary sealed communication with outer frame member 1, the placement of rotary core member 2 within outer frame member 1 being such that when the device is used as intended, fluid will not leak from between the communicating surfaces of said outer frame member 1 and said rotary core member 2.

Figure 5B:
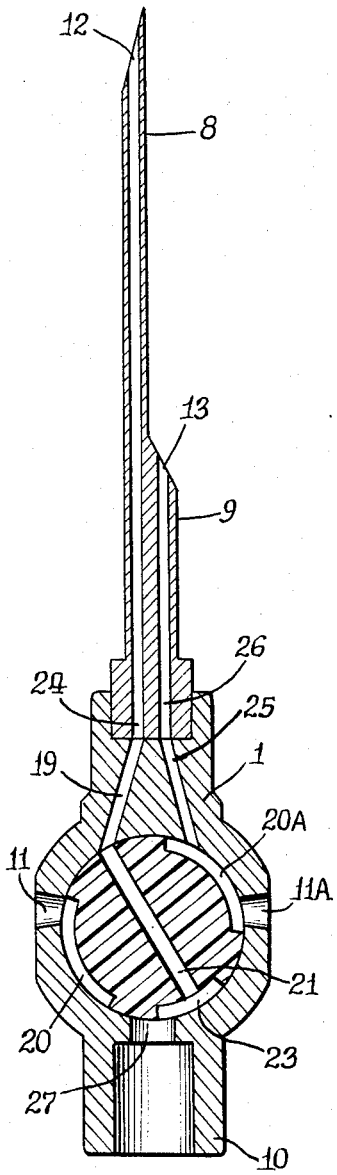
FIG. 5B is a front cut-away section of the device showing the position of the rotary core member for instilling fluid into a container.
Figure 5A:
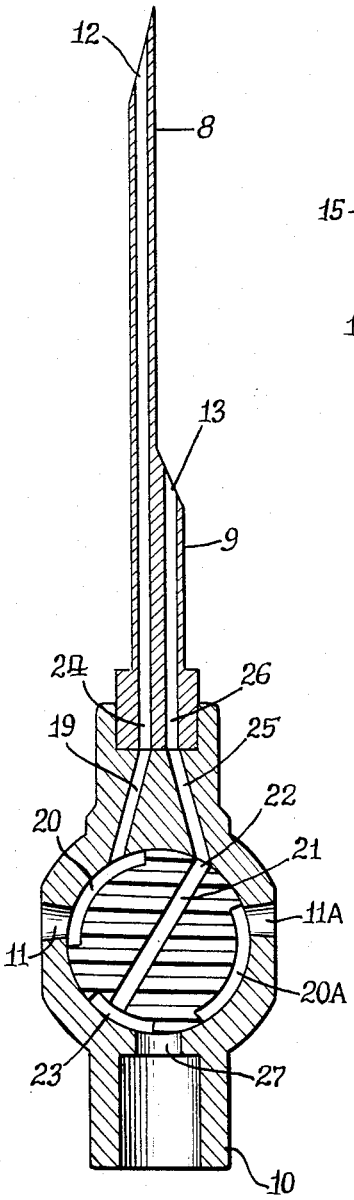
FIG. 5A is a front cut-away section of the device showing the position of the rotary core member for withdrawing fluid from a container.

Cut away view FIG. 5A demonstrates the position of rotary core member 2 when it is desired to withdraw fluid from a container. Cut away view FIG. 5B demonstrates the position of rotary core member 2 when it is desired to instill fluid into a container.

Figure 6A:
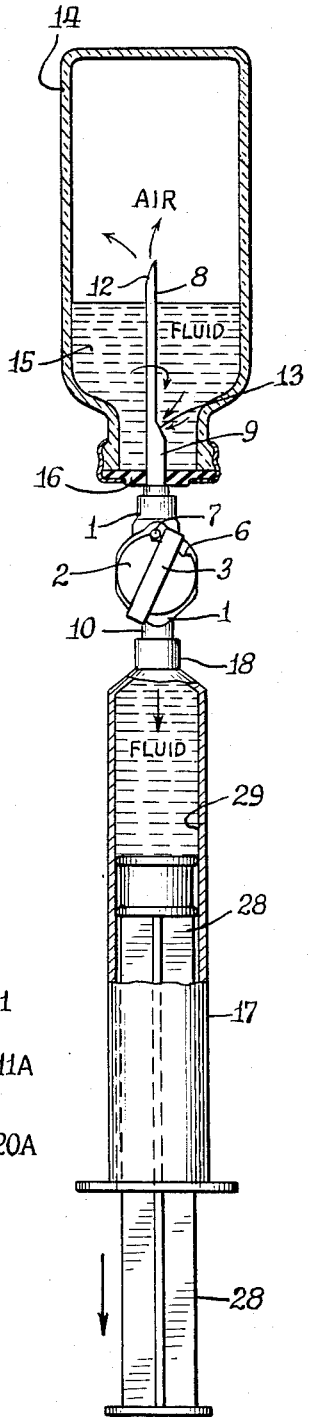
FIGS. 6A and 6B are front views which demonstrate respectively, the operation of the device of FIGS. 1–3 for the withdrawal of fluid from a first container and the transfer of said fluid to a second container.
Figure 6B:
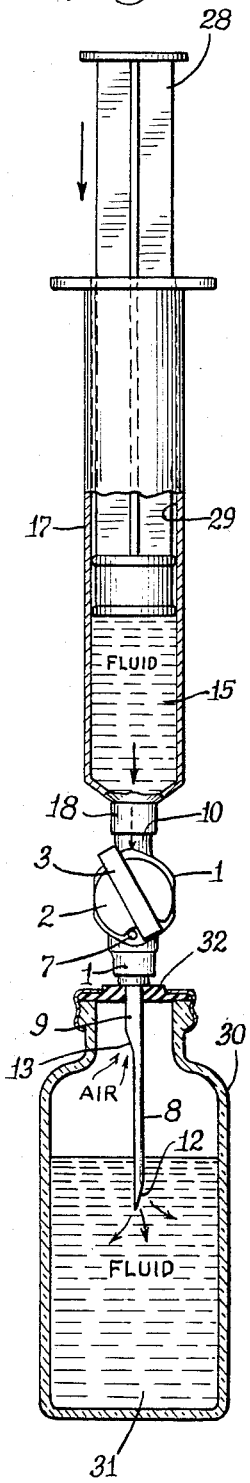

FIGS. 6A and 6B demonstrate the device of the present invention as it is intended to be used. The device of the present invention is affixed to collecting means 17, usually a common plunger syringe, by communicating hollow attachment means 10 with connecting portion 18 of said collecting means 17, such that a sealed connection is achieved. Preferably attachment means 10 is of a design to accommodate collecting means 17 in which connecting portion 18 is of a design known as a Luer-lok® or similar make. However, any suitable compatible design may be employed.

After attachment of the device of the present invention to the collecting means 17 as described above, fluid is withdrawn from a sterile container 14 as demonstrated in FIG. 6A. Generally, this is accomplished by inverting container 14 containing the fluid to be transferred and by inserting hollow core needles 8 and 9 through rubber stopper 16. Rotary core member 2 is aligned to the fluid withdrawal position A as demonstrated by FIGS. 5A and 6A. This is accomplished by manually rotating said rotary core member 2 utilizing handle 3. This rotates rotary core member 2 into a position such that air, enters first air passage 11, flows through rotary core air passageway 20 and through first generally verticle outer frame member passageway 19 in alignment with lower opening 24 of hollow core needle 8. Said air proceeds up the length of hollow core needle 8 and exits through opening 12 thereof and into container 14. The air which enters container 14 exerts a positive pressure on fluid 15 which thereby greatly reduces the force necessary to withdraw fluid 15 from sterile container 14 into collecting means 17. In this position, rotary core fluid passageway 21 is positioned such that the upper opening 22 thereof aligns with second generally verticle passageway 25 of outer frame member 1, which is aligned with lower opening 26 of short hollow core needle 9 and further, aligns rotary core lower opening 23 with lower fluid passageway 27.

To withdraw fluid 15 from sterile container 14, force is manually applied to plunger 28, of collecting means 17 in the direction demonstrated by FIG. 6A and to the point of measurement desired. This creates a collecting cavity 29 within collection means 17 into which fluid 15 freely flows.

When the desired amount of fluid 15 is removed from sterile container 14, long and short single hollow core needles 8 and 9 are withdrawn from rubber stopper 16. The fluid 15 is now ready for transfer and instillation into a second sterile container 30 containing medicament 31.

As can be seen from FIG. 6A, the lengths of long hollow core needle 8 and short hollow core needle 9 should be such that both needles penetrate rubber stopper 16 and such that short hollow core needle 9 penetrates stopper 16 such that most, if not all, of the fluid can be withdrawn. Obviously, this is not extremely critical as the operator can, to a degree, partially withdraw the needles sufficient to remove substantially all of the fluid. Long hollow core needle 8 is desirably of sufficient length to protrude above the upper fluid lead to facilitate entrance of air into the headspace. The long needle 8 should not be too long, however, to permit penetration of both needles 8 and 9 into the container from which fluid is to be withdrawn. By way of example, a length of 1.5 inches and 0.5 inches for long hollow core needle 8 and short hollow core needle 9 respectively would be functional for most purposes.

Long and short single hollow core needles 8 and 9 are inserted through rubber stopper 32 of sterile container 30 as demonstrated in FIG. 6B. Inner movable rotary core member 2 is manually switched to alternate position B as demonstrated by FIG. 5B and FIG. 6B, the position when it is desired to instill fluid 15 contained in collection cavity 29 of collecting means 17 into sterile container 30. For transfer of fluid 15, sterile container 30 is generally maintained in an upright position as demonstrated by FIG. 6B. Pressure is exerted on plunger 28 in the direction demonstrated by FIG. 6B such that liquid 15 is forced from collection cavity 29, through connection portion 18 into hollow attachment means 10. Fluid 15 enters rotary core fluid passageway 21 through lower fluid passageway 27 of outer frame member 1, through outer frame member opening 19, through lower opening 24 of long single hollow core needle 8, and exits through opening 12 of long single hollow core needle 8 and into sterile container 30 where said fluid 15 comes in contact with medicament 31. Fluid 15 entering sterile container 30 displaces air from sterile container 30, which air evacuates through opening 13 of short single hollow core needle 9, passes the length of said needle 9, through lower opening 26 of needle 9, through 25 of outer frame member 1, through second rotary core air passageway 20A and exits said outer frame member 1, through air passage 11A. Air evacuated in this manner facilitates the introduction of fluid 15 into sterile container 30, greatly reducing the amount of positive force applied to plunger 28. When the desired amount of fluid 15 is instilled into sterile container 30, hollow core needles 8 and 9 are withdrawn from rubber stopper 32.

Heretofore, with the conventional syringe method, due to the buildup of a positive air pressure within container 30, medicament which had been mixed with fluid would be forced out of sterile container 30 through holes in rubber stopper 32 when the needle of the conventional transfer means was withdrawn. This is undesirable as the medicament, which may be toxic, splashes on the operator which may cause harm. This also results in the waste of medicament which can be very costly as well as result in inaccurate mixing.

The medicament in sterile container 30 is now ready for subsequent dispensing and use as intended.

If the device of the present invention is intended to be reused, it may now be disconnected from the collecting means 17 by detaching hollow attachment means 10 from connecting portion 18 and appropriately cleaned and sterilized for subsequent use.

These and other embodiments of this invention which are evident are thus claimed as follows:

1. A fluid withdrawal and instillation device for mounting a collecting means for the transfer of fluid from a first container to a second container, said device comprising:

an outer frame member having opposing side walls, an upper portion and a lower portion and containing as its lower portion, hollow attachment means for communication with a connecting portion of a fluid collecting means, a lower fluid passageway in alignment with and above said hollow attachment means, an air passage positioned in and through each opposing side wall of said outer frame member and first and second generally verticle passages positioned at and through the upper portion of said outer frame member;

a first hollow core needle vertically attached to the upper portion of said outer frame member such that the hollow core needle is in alignment with one passage in the upper portion of said outer frame member;

a second hollow core needle, in parallel alignment with said first hollow core needle and attached to the upper portion of said outer frame member such that the second hollow core needle is in alignement with a second passage in the upper portion of said outer frame member, said second hollow core needle being shorter in length than said first hollow core needles;

an inner, movable rotary core member, rotatably secured and in sealed communication with said outer frame member, said rotary core member having therein, a fluid passageway extending vertically therethrough and situated such that said fluid passageway is in alignment with the lower fluid passageway of said outer frame member, whether said rotary core member is in a switched position to withdraw or instill fluid and further situated such that said fluid passageway is in alignment with the second generally verticle passage in said outer frame member to which is attached the second hollow core needle when it is desired to withdraw fluid and which fluid passageway in said rotary core member is in moveably alternate alignment with the first generally verticle passage in said outer frame member to which is attached the first hollow core needle when said rotary core member is positioned so as to instill fluid, and which rotary core member also contains a first air passageway positioned such that when said rotary core member is positioned to withdraw fluid, air entering through a first air passage in said outer frame member enters said first air passageway and passes through the first generally verticle passage in the upper portion of said outer frame member and through the first hollow core needle attached thereto, and which rotary core member also contains a second air passageway positioned such that when said rotary core member is positioned to install fluid, displaced air passes through said second hollow core needle, through said second generally verticle passage in the upper portion of said outer frame member through said second rotary core air passageway and exits through a second air passage in said outer frame member;

positioning means whereby said rotary core member is restrainably aligned in the desired position, to withdraw and instill fluid; and means on said rotary core member member for the manual rotation thereof to the desired position.

2. The device of claim 1 wherein said device can be removed from said collecting means and may be treated for subsequent usage.

3. The device of claim 1 wherein said device is fixably attached to said collecting means.

4. The device of claim 1 wherein said first hollow core needle and said second hollow core needle are fixably attached to said outer frame member.

5. The device of claim 1 wherein said first hollow core needle and said second hollow core needle are removably attached to said outer frame member.

* * * * *